United States Patent [19]

Vallese et al.

[11] 3,936,834

[45] Feb. 3, 1976

[54] HIGH POWERED FERRITE LOADED HELICOPTER ANTENNA

[75] Inventors: Lucio M. Vallese, Glen Ridge, N.J.; Gordon L. Clark, Takoma Park; James C. Bailey, Hollywood, both of Md.

[73] Assignee: The United States of America as represented by the Secretary of the Navy, Washington, D.C.

[22] Filed: June 21, 1972

[21] Appl. No.: 266,524

[52] U.S. Cl. ..... 343/708; 343/787; 343/830

[51] Int. Cl.[2] ..... H01Q 1/28

[58] Field of Search ..... 343/705, 708, 787, 856

[56] References Cited

UNITED STATES PATENTS

| | | | |
|---|---|---|---|
| 2,404,093 | 7/1946 | Roberts | 343/708 |
| 2,748,386 | 5/1956 | Polydoroff | 343/787 |
| 3,702,479 | 11/1972 | Uhrig | 343/705 |

*Primary Examiner*—Malcolm F. Hubler
*Assistant Examiner*—Richard E. Berger
*Attorney, Agent, or Firm*—R. S. Sciascia; Arthur L. Branning; R. O'Neill

[57] ABSTRACT

An inductive, internally fed, ferrite-loaded antenna mounted at the geometrical center of a helicopter. The antenna is capable of transmitting in the 2–30 MHZ range with particularly good characteristics between 2.0–3.5 MHZ and employs the air frame as a radiating element. The radiation pattern is circular and extends for a radius greater than 200 mi. at an altitude of 300 feet.

5 Claims, 7 Drawing Figures

HIGH POWERED FERRITE LOADED HELICOPTER ANTENNA

BACKGROUND OF THE INVENTION

This invention relates to helicopter antennas and specifically to helicopter antennas which operate in the HF range. Since a relatively high level field intensity can be generated by employing the air frame as the main radiator of an antenna system, it is advantageous to devise means for obtaining an optimum coupling between the transmitter and the air frame. Efforts have been made to take advantage of the interaction, however impedance matching, and overall radiation efficiency have prohibited any significant advances in the art.

There are two basic types of HF antennas known to the prior art. The first type radiates independently of the air frame and includes devices such as simple wire antennas. The second type of antenna utilizes a section of surface of the air frame as a main radiator and includes isolated cap antennas. Although the first type are easy to install they exhibit low efficiency and require the use of complicated inductive couplers, and the second type usually requires an air frame modification. To say the least, most HF helicopter antennas and their associated couplers of the prior art have been unsatisfactory.

Considering the drawbacks of the prior art we have developed a ferrite loaded antenna which utilizes the helicopter air frame surface as a radiator, does not require modifications of the air frame, does not interfere with the flight controls, and has the ability to radiate throughout a 240 mile radius at an altitude of 300 feet above the surface of the earth.

SUMMARY

A helicopter antenna system which utilizes an axial metallic cylindrical rod is surrounded by ferrite wafers which have low bulk loss and high core values. The ferrite wafers, usually in the form of a toroid having a slot, are in direct internal contact with a metallic rod so as to decrease the deleterious hysteresis effects. The overall structure is encased in fiberglass and mounted a distance D from the helicopter; at the helicopter's geometric center. The vertically polarized antenna is end-fed to provide an unbalanced feeding scheme, and is of an inductive nature. When the antenna is properly spaced from the aircraft, the entire air frame and antenna are capable of radiating in a circular pattern.

The frequency of operation is between 2–30 MHZ with the most optimum performance between 2–3.5 MHZ.

OBJECTS OF THE INVENTION

It is an object of the present invention to provide a helicopter antenna which utilizes a ferrite load and does not require any substantial modifications to the air frame.

A further object of this invention is to provide an antenna system wherein the air frame radiates so as to produce a circular pattern having a radius of at least 200 miles at an altitude of 300 feet.

Another object of the invention is to provide a helicopter HF antenna system giving good field between 2 MHZ and 30 MHZ.

Other objects of the invention will become readily apparent to those skilled in the art by referring to the following detailed description in connection with the accompanying drawings wherein:

DRAWINGS

DETAILED DESCRIPTION

Figure 1:
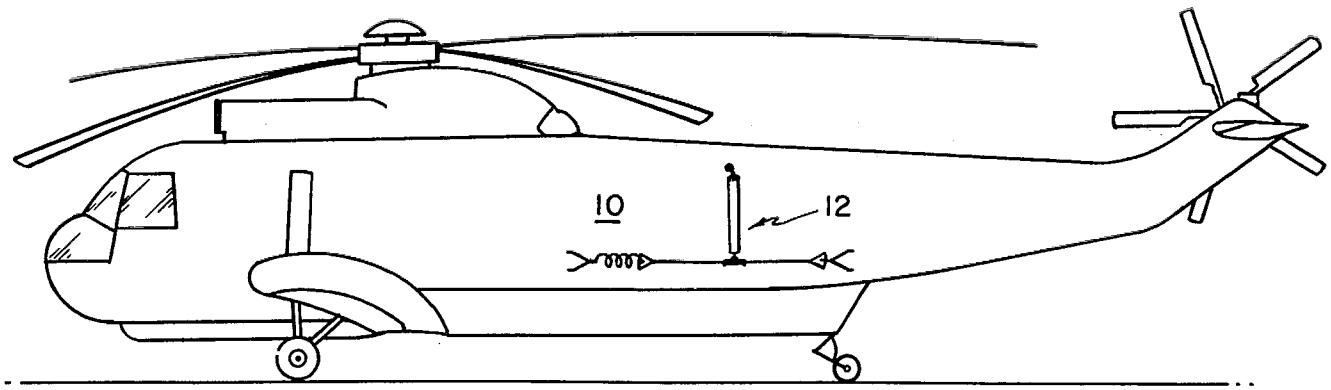
FIG. 1 depicts a typical helicopter with the antenna located at the geometric center.

Referring to FIG. 1, a typical helicopter 10 is shown. Located at the geometric center of the air craft is the novel antenna 12. Although the antenna is shown to be mounted on the port side of the air frame it could also be mounted on the starboard side of the aircraft.

Figure 2:
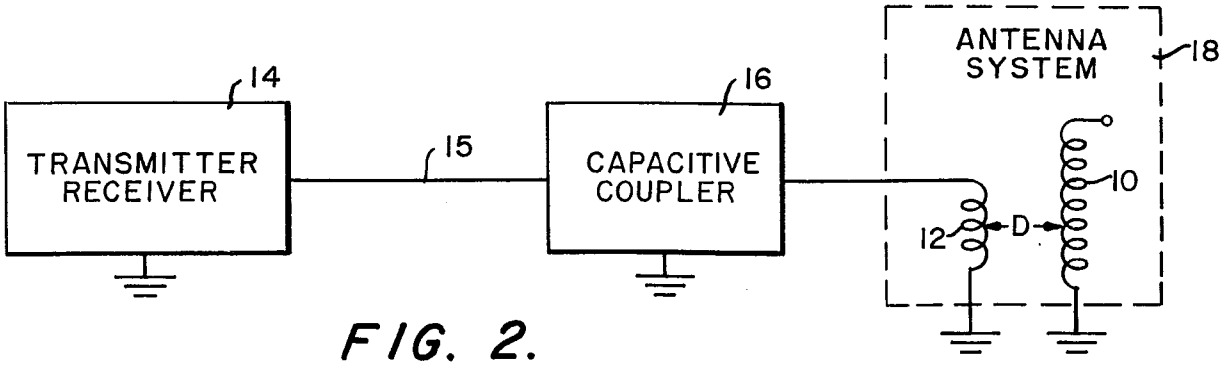
FIG. 2 is a block diagram representative of the antenna system.

Essentially this antenna system has inductive properties as shown in FIG. 2. Transmitter (or receiver) 14 drives antenna coupler 16 by way of line 15. Since this antenna system 18 is inductive, it follows that coupler 16 must be of a capacitive nature to minimize the reactive nature of the system and permit an impedance match for maximum power transfer. As shown in FIG. 2, antenna system 18 includes antenna 12, which by analogy to a transformer drives the helicopter air frame 10. Although the air frame 10 appears to be disjointed from the system, it in fact is responsible for omnidirectional radiation of the entire system. It should be noted that the spacing between the air frame 10 and the antenna 12 is labeled as D and is typically 11''. for optimum performance within the recited frequency.

Figure 4:
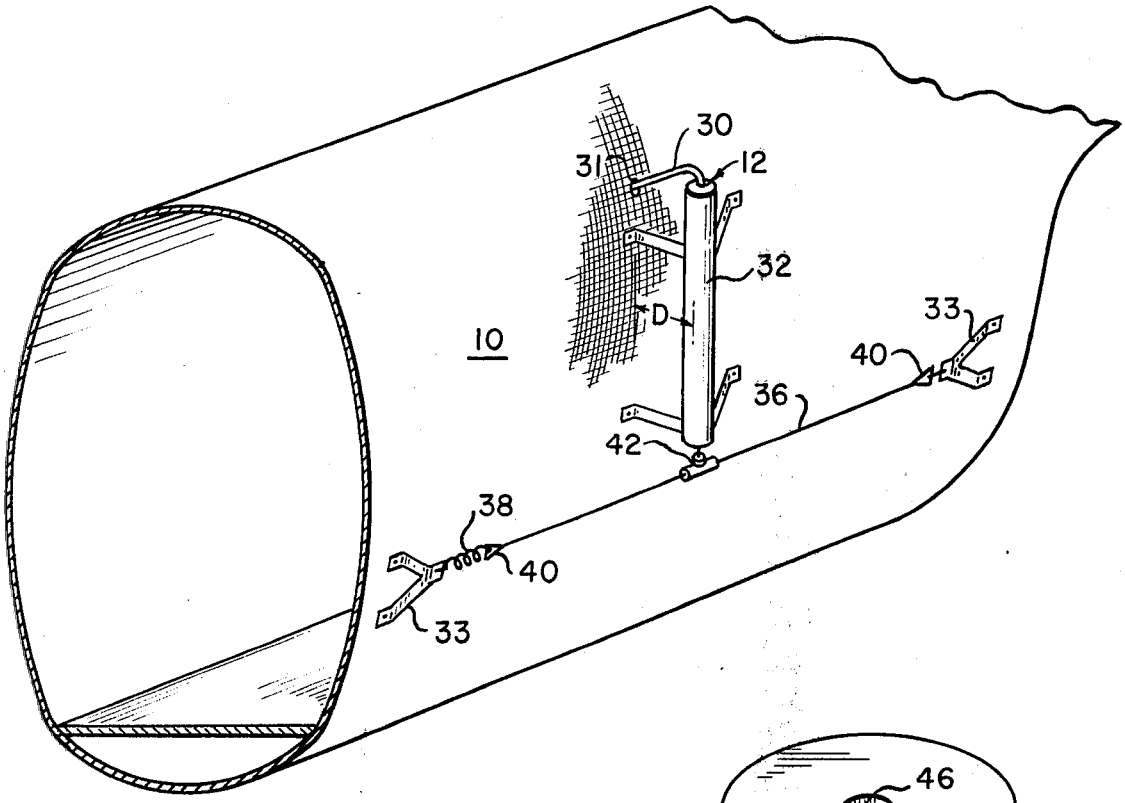
FIG. 4 is a perspective view of the ferrite loaded antenna mounted on the side of a helicopter.
Figure 3:
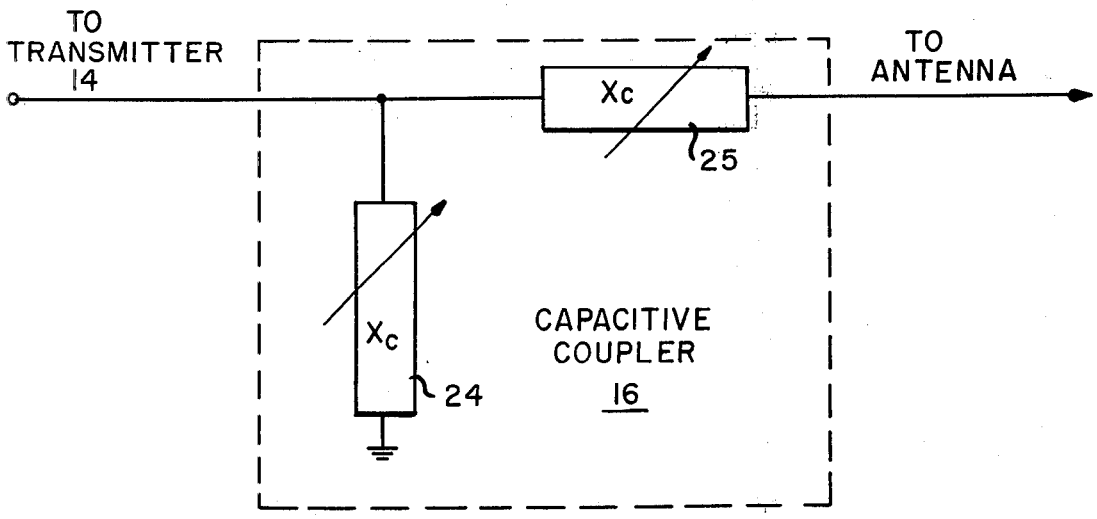
FIG. 3 is a schematic of the capacitive coupler.

FIG. 3 is a schematic of the antenna coupler 16. The coupler is formed from two variable capacitors 24 and 25 and is constructed in L sections. The purpose of the coupler 16 is to tune out the reactance from the antenna system 18 so that maximum power transfer takes place beween transmitter 14 and antenna system 18. Referring to FIG. 4, detailed diagram of the antenna system is shown and includes antenna 12 and air frame 10. The antenna is fed by forty thousand volt feed wire 30 from a transmitter located within the fuselage of the aircraft near the antenna feedthrough insulator 31. The antenna 12, separated from aircraft 10 by a distance D, is fastened by V brackets 33 to the helicopter. The vertically aligned rod portion 32, which accepts the power from the feed wire 30, comprises an axially disposed wire (usually brass) surrounded by stacked ferrite wafers similar to that shown in FIG. 5 and is encased in fiberglass. The length of rod 32 is approximately 5 feet when operating in the 2–30 MHZ range. The antenna system utilizes a balance wire 36 which is connected to the rod 32 by way of T section 42. The balance wire 36 is held in place by terminations 40, spring 38, and V brackets 33. The T connection divides the length of the balance wire approximately in half such that each half is about 5 feet long. The balance wire is used to further match the impedance of the antenna with the air frame.

Figure 5:
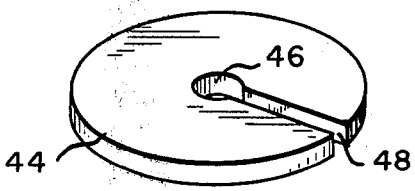
FIG. 5 is a showing of the ferrite wafer.

FIG. 5 shows wafer 44 having center hole 46 and slot 48. The diamter of the wafer is approximately 1 inch while the thickness is about ⅛ of an inch. The center hole 46 is for the brass rod and the slot 48 serves two purposes. One function of the slot 48 is to reduce the eddy currents in the ferrite material so as to help reduce the heat generated in the antenna during transmit operation. In order to prevent magnetic shunting of the slots, the stacked wafers should be kept in alignment.

Figure 6:
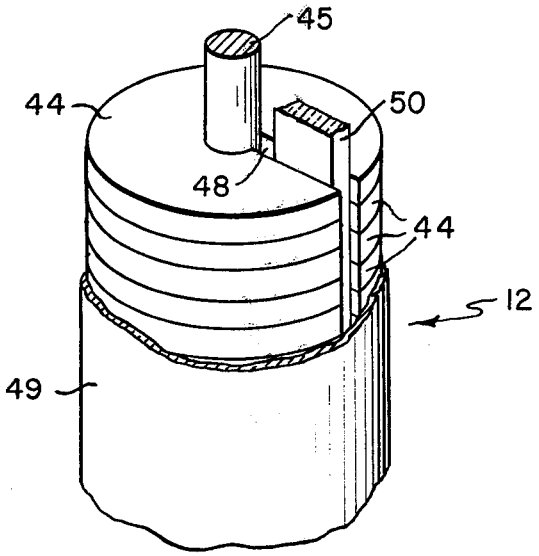
FIG. 6 is a perspective view of the ferrite loaded antenna system specifically depicting the stacked wafers.

Referring to FIG. 6, a number of stacked wafers 44 are held in alignment by an insulative member 50 having a rectangular cross-section fitted through slot 48. Brass wire or rod 45 extends through the multitude of center holes 46 and is finally connected to balance wire 36 at one end and feed wire 30 on the other.

Figure 7:
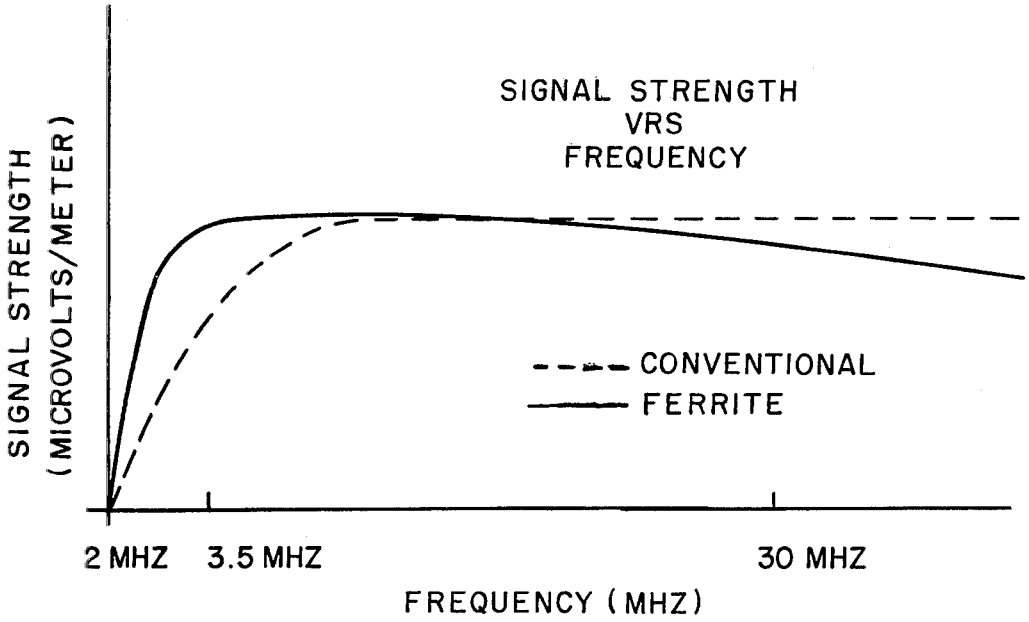
FIG. 7 is a graph of signal strength vs. frequency for this antenna system as compared to a conventional wire antenna.

Referring to FIG. 7, a graph of signal strength vs. frequency is shown for the instant ferrite antenna and a conventional helicopter antenna system. It should be noted that the graph for the ferrite antenna applies to a circular antenna pattern and is valid throughout a 360° rotation. However, such may not be the case with the conventional antenna. FIG. 7 clearly shows that the ferrite antenna outperforms the conventional wire antenna systems within the range 2–3.5 MHZ.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is;

1. An antenna system mounted upon the side of a helicopter comprising:

means for feeding a signal to and from a transmitter and receiver;

radiating means having a ferrite loading connected to said feeding means, said radiating means including a vertically aligned rod encased in ferrite material;

said radiating means being mounted a distance D from the surface of the helicopter whereby the helicopter is coupled to the radiating means and a circular antenna radiation pattern is generated by the helicopter and the radiating means.

2. The device as claimed in claim 1 wherein said vertically aligned rod is end-fed by said feeding means; and further including balance means connected to the other end of said rod to aid in impedance matching.

3. The device as claimed in claim 1 wherein the antenna system further includes an antenna coupler means disposed between said radiating means and said receiver and transmitter to aid in impedance matching.

4. The device as claimed in claim 2 wherein said radiating means having ferrite loading comprises: a brass rod encased in a plurality of stacked, torroidally shaped ferrite wafers.

5. The device as claimed in claim 3 wherein said distance D is 11 inches, the length of said radiating means is approximately 5 feet long, said balance wire means is a approximately 10 inches long and the frequency of the transmitter and receiver operation is between 2–30 MHZ.

* * * * *